United States Patent [19]

Schneider

[11] Patent Number: 4,925,439

[45] Date of Patent: May 15, 1990

[54] APPARATUS FOR STACKING AND POSSIBLY BLOCKING PLASTIC BAGS

[75] Inventor: Jakob Schneider, Miederkassel-Mondorf, Fed. Rep. of Germany

[73] Assignee: Lemo M. Lehmacher & Sohm GmbH, Niederkassel-Mondorf, Fed. Rep. of Germany

[21] Appl. No.: 375,770

[22] Filed: Jul. 5, 1989

[30] Foreign Application Priority Data

Jul. 7, 1988 [DE] Fed. Rep. of Germany ..... 3823009

[51] Int. Cl.[5] ..... B31B 23/98

[52] U.S. Cl. ..... 493/204; 414/27; 414/790.2; 414/790.4

[58] Field of Search ..... 493/194, 196, 204; 414/27, 790.2, 790.4, 793.9, 907; 271/82, 213

[56] References Cited

U.S. PATENT DOCUMENTS

| | | | |
|---|---|---|---|
| 4,395,252 | 7/1983 | Lehmacher | 493/28 |
| 4,451,249 | 5/1984 | DeBin | 493/204 |
| 4,692,134 | 9/1987 | dos Santos Copia | 493/196 |
| 4,854,928 | 8/1989 | Fukuyama | 493/28 |

*Primary Examiner*—William Terrell

*Attorney, Agent, or Firm*—Herbert Dubno

[57] ABSTRACT

Plastic bag are stacked as they are received from a bag making machine by a radial arm transfer wheel whose suction arms engage the bags by transferring edges thereof and with the ends of the arms so that the bags are pressed onto needles of needle bars on a needle bar basket. The needle bars are rotated, with the bags suspending therefrom the spindling position through an intermediate position into a smoothing and removal position in which the hanging stack is lifted to a horizontal orientation and smoothed by a beam movable above the stack and having a smoothing brush engaging the stack. In this latter position a stripper is shifted past the needle bar therefrom. The stack is carried away by a clamp.

5 Claims, 3 Drawing Sheets

APPARATUS FOR STACKING AND POSSIBLY BLOCKING PLASTIC BAGS

FIELD OF THE INVENTION

Our present invention relates to an apparatus for the stacking and, if desired, blocking, (i.e. making up stacks of bags in block or pad form) of plastic bags. More particularly, the invention relates to the collection of bags downstream of a bag making machine in stacks which then may be fixed together, packaged or otherwise transported in stack form.

BACKGROUND OF THE INVENTION

The handling of plastic bags downstream of a bag making machine is described in the following commonly owned U.S. Pat. Nos. 4,270,908 issued 2 June 1981; 4,333,298 issued 8 June 1982; 4,342,564 issued 3 Aug. 1982; 4,378,268 issued 29 Mar. 1983; 4,398,903 issued 16 Aug. 1983; 4,368,051 issued 11 Jan. 1983; 4,395,252 issued 26 Feb. 1983; 4,549,877 issued 29 Oct. 1985; 4,662,864 issued 5 May 1987; 4,536,174 issued 20 Aug. 1985; 4,552,551 issued 12 Dec. 1985; 4,512,757 issued 23 Apr. 1985; 4,614,472 issued 30 Sept. 1986; 4,695,346 issued 22 Sept. 1987 and 4,631,047 issued 23 Dec. 1986.

Reference may also be had to copending application Ser. No. 7/205,432 filed 10 June 1988.

From these patents and the copending application, it will be apparent that a star-type wheel may be used to transfer bags arriving from the outlet end of a plastic bag making machine to a stacking location at which the bags are stacked by threading them onto pins which can accommodate a number of such bags for further processing, e.g. joining of the bags of the stack onto a pad or collection.

The bags may be so stamped to form so-called "shirt" bags, and the star wheel arrangement can be provided with a variety of other elements to properly position and manipulate the bags.

In U.S. Pat. No. 4,451,249, for example, a bag handling apparatus is described which comprises a star wheel-type transfer device, a pin or needle stacker onto which the bags carried by the star wheel are threaded, and a stamping device.

The star wheel transfer device has suction arms which grip the bags as they arrive from an automatic plastic bag making machine and carry the bags onto the needles of the stacking device until a bag stack of a predetermined number of bags is found in the stacking position. In a periodic manner, the stack is moved from the stacking or needle-threading position. Of course, a transport device must be provided downstream of the stacker to allow this action.

In the prior art device of U.S. Pat. No. 4,451,249, the star wheel requires two plastic bags hanging together to be moved transversely. The pickup device moves intermittently in the working direction and has the form of a conveyor belt provided with the needles. The interconnected pair of plastic bags which are to be stacked by the star wheel are caused to be deposited above this conveyor in a saddlelike orientation, are threaded onto needles and are divided on this conveyor so that two stacks are formed thereon. The formation of two bag stacks by the movement carried out by the star wheels of two bags hanging together, provides a relatively high air resistance to movement of the bags.

This creates problems in practice, because the bags are held only by suction to the suction arms. To prevent an uncontrolled shifting of the bags carried by the arms, the movements cannot be too rapid and the cycling time of the apparatus must not be excessive. This means that the speed at which the bags are stacked cannot be high either.

This presents a serious problem because bag making machines are increasingly being designed to supply bags at faster speeds.

OBJECTS OF THE INVENTION

It is, therefore, the principal object of the present invention to provide a bag stacking device or apparatus which can be provided downstream of a bag making machine, which will improve upon earlier devices of this type.

Another object of my invention is to provide a bag stacker utilizing a star wheel or radial arm arrangement but which can operate at greater speeds than has hitherto been the case.

It is also an object of this invention to provide a bag stacking apparatus which will avoid problems hitherto encountered with prior art systems and which will permit operation with low cycling times and high speeds while nevertheless insuring the highly reliable transfer of bags utilizing the star wheel or radial arm transfer device.

SUMMARY OF THE INVENTION

These objects and others which will become apparent hereinafter are attained, in accordance with the invention by providing the star wheel or radial arm transfer device so that the plastic bags are seized along the needle-threading edge thereof by the outer ends of the suction arms of this device.

According to the invention, the spindling device having the needles comprises a needle basket rotatable about an axis parallel to the star wheel axis and formed with a plurality of needle bars angularly equispaced from one another about the needle basket axis and equidistant from this axis and parallel to one another.

The free ends of the arms, therefore, are designed to enable the bags to hang downwardly from them while the bags are gripped only by the needle threading edges thereof and are carried onto the needles of a bar whose needles are turned upwardly at the stacking location. By a counter rotation of the basket with respect to the rotation of the star wheel, the downwardly hanging bags are carried by the success of needle bars into a path of a bag stack smoothing device which can include an endless continuously displacement working chain whose transverse rods engage the hanging bag stack and are drawn therealong to raise the stack to the horizontal and smooth the latter. Above the stack, a smoothing beam with a smoothing brush can be displaceable to smooth out the upper part of the stack as it is raised to a substantially horizontal position. A device for removing the stack from the needles is then provided in the path of the stack to free the bag stack from the needle bar upon which it has been threaded.

As will be apparent from the foregoing, the radial-arm transfer device engages the successive individual bags arriving from the bag-making machine by the pickup edge of the bag, carries the bag from above onto the stacking needle bar of the basket until a predetermined number of such bags have been placed on the needles of the respective bar. During the latter step, the bags hang from the free ends of the arms and, after being placed upon the needles of the needle bar are suspended from the needle bar. Thus the bag stacks in formation hang downwardly from the respective needle bar.

Periodically and in a stepwise manner, the needle bar basket is rotated to carry a full stack into a lower position below the stacking position, i.e. into an intermediate position, and then into a position in which the bags are placed in the path of the smoothing chain. The latter position is referred to as a smoothing and discharge position.

In this latter position, a stack of bags suspended from the needle bar is engaged from binding this stack by a moving rod of the chain and swing into a horizontal position where the stacking can be supported by such rods and the movement of the rods along the stack can provide a smoothing action. In this position, moreover, the smoothing beam can slide over the stack to further smooth the latter with its brush.

The free end of the stack is then turned away from the pickup edge and can be engaged by a removal gripper and a dethreading or stripping arrangement is provided adjacent and above the needle basket at the opposite end of the stack to remove the stack from the needles on which the bags are threaded, once the gripper has become effective to engage the stack.

According to a feature of the invention, the radial arm transfer device has, at the free ends of its suction arms, spring elements or the like which serve to assist the threading of the needles through the bags or the spindling of the bags onto the needle bar. These elements can be referred to herein as spindling-assistance elements. These spring elements can be deflected by the stack previously formed as each new bag is spindled on the needles and the respective arm passes by the stack.

The needle bars can advantageously be provided with clamping devices which serve to engage over the engagement edges of the bags of each stack and can be openable and closable by cams or the like to assist in retaining the bags of the stack on the basket as the needle bar is swung from the bag receiving position to the smoothing and release position.

The device of the invention allows the radial arm transfer unit, the needle bar arrangement and the stripper for removing the stack from the needles to be constructed relatively simply. For example, the arrangement of the invention disposes a stripper immediately above the smoothing and discharge position so that a simple lowering movement rolling of the stripper relative to the inverted needle bar will remove the stack therefrom.

Above the smoothing and discharge position of the needle bar, moreover, a blocking device can be provided which can be also raised and lowered so that in its lowered position after advance of the respective needle bar, the engaging edges of the bags of the stack can be joined together, e.g. via a heat sealer to produce the pad. Of course, a corresponding anvil or support may be required for the blocking device. The fusion can be effected by a heating bulb or plug. Using the principal of the invention, I can effect a transfer of the bags with the aid of the radial-arm transfer device with comparatively little air force since two bags hanging together need not be transferred. The plastic bags can be stacked and transferred with the suction arms at very short cycling times and high transfer speeds. Since the radial arm transfer device engages only the pickup edge of the bag it is possible, in accordance with the invention to provide a support arm between the two suction arms engaging each bag and which need only rest upon the picked up bag and need not be formed as a suction arm.

According to the invention, moreover, stacking of bags is effected at high speeds and with short cycling times in a system which is compatible with providing a number of units as described side by side so that two rows to five rows of bags of bags can be stacked simultaneously. The radial arm transfer device may thus be provided with a corresponding number of arms.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
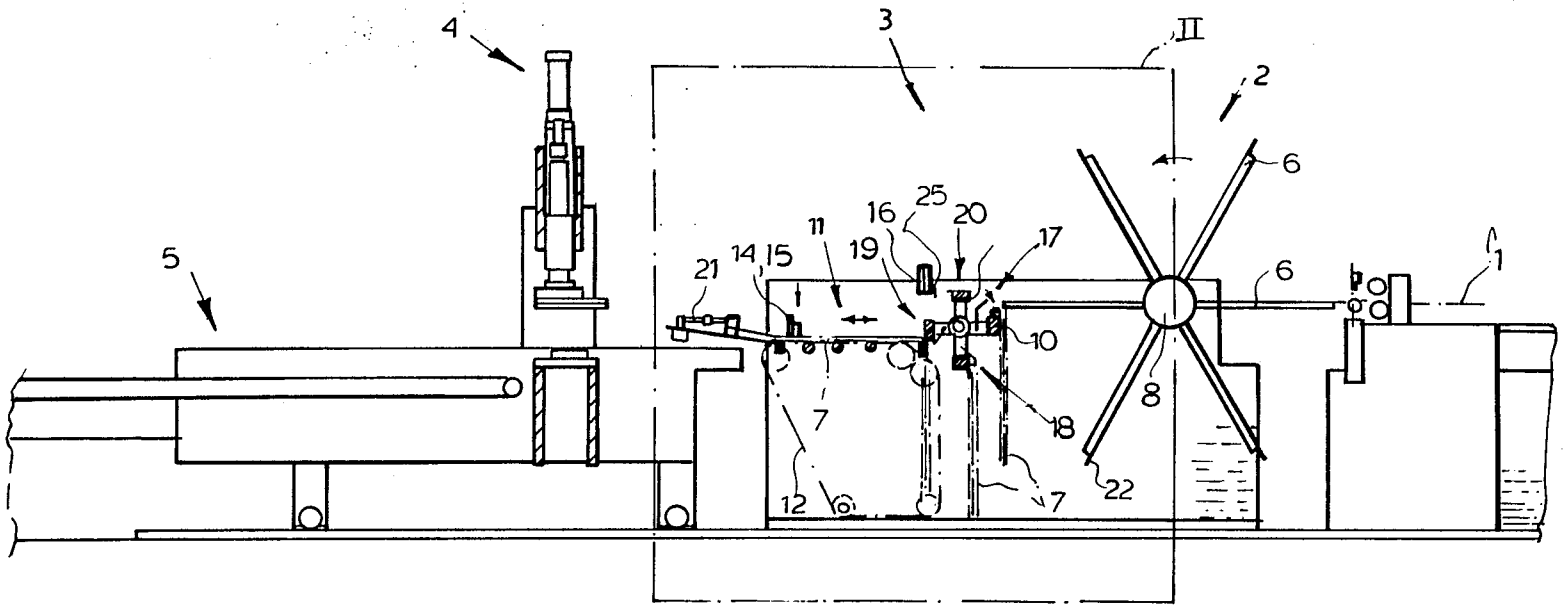
FIG. 1 is a side elevational view of the apparatus according to the invention.

The apparatus shown in the drawing serves to stack and, if desired, block or pad plastic bags which, in the embodiment shown, are so-called shirt bags, the apparatus being located downstream of a plastic bag fabricating machine outputting three rows of such bags. The bags are indicated by the reference numeral 1.

The apparatus comprises, as basic elements, a radial-arm or star wheel transfer device 2, a spindling device 3 on the needles of which the bags are threaded, and a stamping device 4 shaping the bags. A device 5 referred to generally as a transport device, serves to carry away the completed bag stack.

The radial arm transfer device 2 comprises a plurality of pairs of radial arms 6, each of which is a suction arm positioned so that each of pairs suction arm grips the the pickup edge of a respective edge of a respective bag.

The spindling device 3 moves the bag stack 7 assembled on the needles of each needle bar, once a predetermined number of bags have been applied thereto and stacked, cyclically and without a deadhead stroke or cycle from the spindling position, ultimately into a position which the stack is removed from the needles. The lack of a deadhead cycle or stroke simply means that there is no empty movement of a needle bar oppositely to the direction of advance of the needle bars.

The apparatus utilizes a unique configuration of the spindling device 3 and its relationship with the radial arm transfer device 2.

The radial arm transfer device 2 picks up the horizontally advancing individual bags 1 at the outer ends of the suction arms 6 of the star wheel 8 at the pickup edges of the bags at which the bags are to be forced onto the needles of the spindling device.

The spindling device 3 comprises a needle basket 9 having an axis parallel to the axis of rotation of the radial arm wheel and is rotatable in the opposite sense. The needle basket 9 comprises a plurality of angularly equispaced, mutually parallel needle bars 10 which are equidistant from the basket axis.

According to the invention, moreover, a stack smoothing device 11 is provided to engage the stacks moved into the range of action of the smoothing device.

The smoothing device comprises a cyclically operating drive chain 12 having transfer rods 13 which engage binding the stack rotated onto this region. Each stack is then lifted into a horizontal position and is smoothed out by the rods 13 which are displaced to the left, i.e. in the direction of advance of the stacks.

Above the path of the rods 3 is a smoothing beam 14 which is movable back and forth by an appropriate actuator so that its smoothing brush 15 can smooth out the stack on the opposite side thereof. The smoothing beam 14 can also be raised from engagement with stack and lowered into such engagement.

Figure 2:
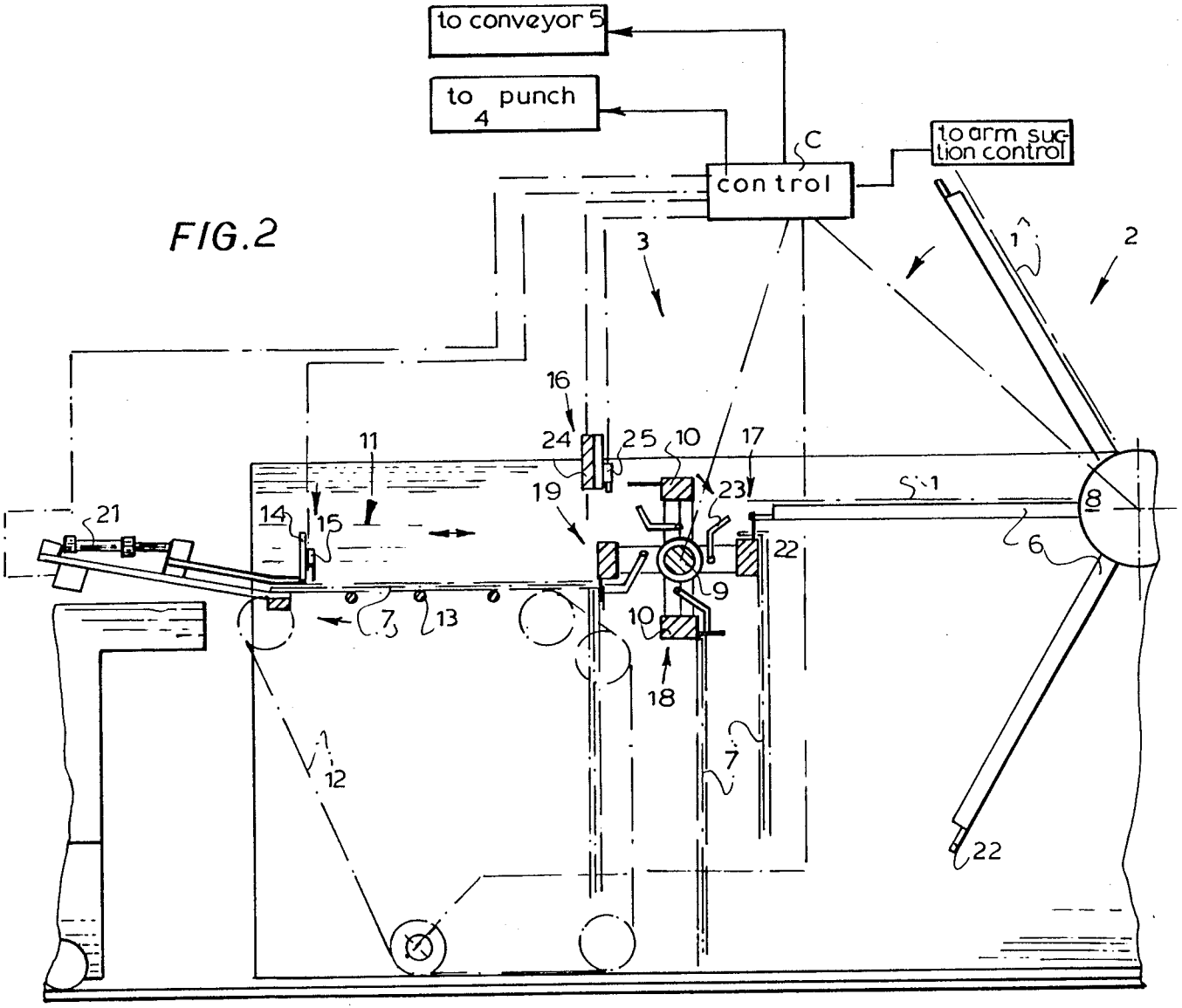
FIG. 2 is a detailed view of the region II of FIG. 1, partly in cross section and with parts broken away.

Finally, a removal device 16 is provided which liberates the stack 7 of the bags 1 from the needle bars 10. As FIGS. 1 and 2 show, the bags which are received by the needle bar 10 having its upwardly turned needles in the range of action of the radial arm transfer device, hang downwardly from their pickup edges as the bags are stacked on the needle bar at the extreme right-hand position of the basket.

As is also apparent from these figures, when each needle bar has received a predetermined number of bags, the basket of the spindling device 3 is rotated briefly to present another needle bar in the position in which the bags can be impaled on the needles and to swing the fully laden needle bar into a lower intermediate position of the basket.

In the drawing, the spindling position has been represented at 17 and this latter intermediate position at 18. In both positions, of course, the bags of the stack hand downwardly.

In the next partial rotation of the basket, the needle bar is brought into a smoothing and removal position 19 at which the stack is smoothed and removed from the needle bar. In yet another partial rotation and in the next stacking cycle, the needle bar 10 from which the stack has been removed, is stationed in the waiting position 20.

At the smoothing and removal position 19, the stack 7 hangs vertically from the needle bar and is in the path of the rods 13 which, upon rotation of the chain 12, lift the stack 7 into a horizontal position as will be apparent from FIGS. 1 and 2. The free or lower end of the stack is thus raised until it lies to the left (FIGS. 1 and 2) and can be engaged by a gripper 21 of a transporter for the stack 7. When the gripper 21 engages the free end of the stack, the removal device 16 liberates the stack 7 from the needles of the needle bar 10 in position 19 by simply pressing the transport edges of the bags downwardly and thereby drawing the bags off the downwardly turned needles.

Figure 3:
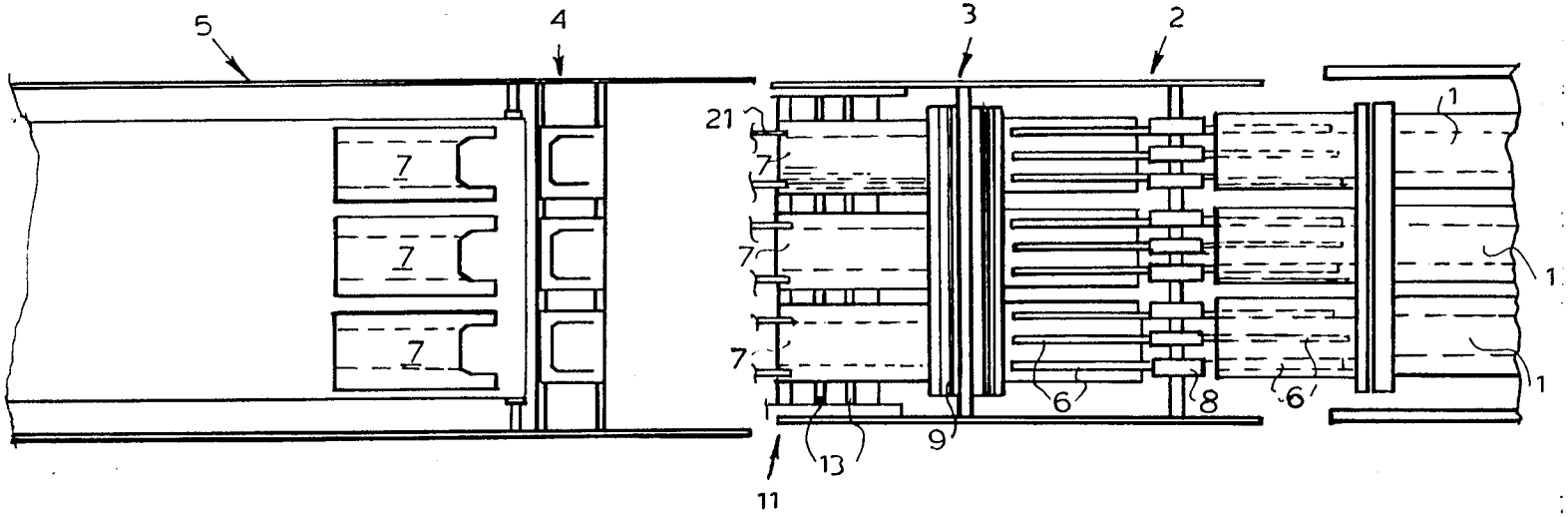
FIG. 3 is a plan view of the apparatus of FIG. 1.

As FIG. 3 makes clear, the transfer device 2 may have auxiliary spindling elements which reach over the needle bar 10 in the position 17 and are deflectable as each arm swings past the needle bar. These elements serve to assist in spindling the bags onto the needles of the needle bar and to sweep the bags downwardly. They can be spring tongs or the like elements.

In the illustrated embodiment and in the preferred embodiment of the invention, three arms 6 engage the pickup edge of each bag.

Furthermore, each needle bar 10 is provided with a clamping device 23 which can be opened and closed by a cam as the respective basket rotates, so that as the basket rotates to carry a stack of bags out of the position 17, the clamps 23 engage over the pickup edges of the bags of the respective stack. The clamping devices open as the stack is moved into the smoothing and removal position 19.

FIG. 2 shows also that the removal device 16, which is vertically shiftable, cooperates with a stripping bar 24 which is located above the smoothing and removal position 19 and which can slide past each bar 10 in this position as the stripper is moved downwardly to remove the bags from the respective needle bar 10.

Above the smoothing and transfer position 19, a block device 25 can be provided in the form of heating bulbs or the like which can fuse the bags of the stack into a pad. An anvil cooperating with the padding unit 25 has not been illustrated but, of course, will normally be provided. The padded stack can be carried away by a conveyor 25 and, of course, stamping can be carried out at 4 to effect final shaping of the bags, e.g. to the shirt configuration shown in FIG. 3. The various elements can be coordinated in time in accordance with modern control technology, utilizing limit switches or microprocessor controls to synchronize the various movements. The control device has been represented at C diagrammatically in FIG. 2.

I claim:

1. An apparatus for stacking plastic bags, comprising:

radial arm transfer means having a wheel provided with a plurality of radial suction arms engageable with respective plastic bags along transport edges thereof and rotatable about a wheel axis for carrying said bags to a spindling position;

a spindling device adjacent said transfer means and comprising a needle basket rotatable about an axis parallel to said wheel axis and formed with a plurality of needle bars angularly equispaced about said axis of said basket and having respective needles thereon whereby the needles of each needle bar are oriented upwardly at said spindling position whereby each bag is threaded on the needles of a respective needle bar in said position until a stack of bags is formed of the respective needle bar, said bags hanging downwardly from the respective needle bar;

means for cyclically rotating said basket so that each of said needle bars, with a respective stack suspended therefrom is displaced cyclically into a smoothing and removal position;

a stack-smoothing device having an endless chain with rods engaging behind each stack suspended from a bar in said smoothing and removal position for lifting the respective stack into a horizontal orientation, and a beam movable back and forth above a stack in said horizontal orientation and provided with a smoothing brush for smoothing said stack; and a stripping device effective in the smoothing and removal position of each of said needle bars for stripping the respective stack therefrom, said needle bars rotating successively in said basket from said spindling position into a lower intermediate position between said spindling position and said smoothing and removal position and into an upper waiting position between said smoothing and removal position and said spindling position.

2. The apparatus defined in claim 1, further comprising spindling-assisting elements at ends of said suction arms for facilitating the spindling of said bags onto a needle bar positioned in said spindling position and thereafter passing along the bags suspended from said needle bar at said spindling position.

3. The apparatus defined in claim 1, further comprising clamping means cooperating with said needle bars is engaging a stack of said bags during movement of said stack between said spindling position and said smoothing and removal positions.

4. The apparatus defined in claim 1, wherein said stripping device comprises a stripping bar deposited above a needle bar in said smoothing and removal position and displaceable based on the respective needle bar upwardly and downwardly to strip a stack from a needle bar in said stripping and removal position.

5. The apparatus defined in claim I, further comprising a blocking device for joining the bags of each stack disposed above a needle bar in said smoothing and removal position.

* * * * *